US006736596B2

(12) United States Patent
Ito et al.

(10) Patent No.: US 6,736,596 B2
(45) Date of Patent: May 18, 2004

(54) SHROUD INTEGRAL TYPE MOVING BLADE AND SPLIT RING OF GAS TURBINE

(75) Inventors: Eisaku Ito, Hyogo (JP); Souichirou Tomimoto, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 70 days.

(21) Appl. No.: 10/167,608

(22) Filed: Jun. 13, 2002

(65) Prior Publication Data

US 2003/0007866 A1 Jan. 9, 2003

(30) Foreign Application Priority Data

Jun. 14, 2001 (JP) ..... 2001-180127

(51) Int. Cl.[7] ..... F01D 11/02

(52) U.S. Cl. ..... 415/173.1; 415/173.1; 416/189

(58) Field of Search ..... 415/173.1, 173.4, 415/173.5, 173.6, 174.5; 416/189, 192, 195

(56) References Cited

U.S. PATENT DOCUMENTS 5,290,144 A * 3/1994 Kreitmeier ..... 415/173.1

6,068,443 A 5/2000 Aoki et al. ..... 415/173.5

FOREIGN PATENT DOCUMENTS

| | | |
|---|---|---|
| JP | 10-266804 | 10/1998 |
| JP | 10-306702 | 11/1998 |
| JP | 10-311205 | 11/1998 |
| JP | 10-317904 | 12/1998 |
| JP | 11-148308 | 6/1999 |

* cited by examiner

*Primary Examiner*—Edward K. Look
*Assistant Examiner*—Dwayne J. White
(74) *Attorney, Agent, or Firm*—Oblon, Spivak, McClelland, Maier & Neustadt, P.C.

(57) ABSTRACT

A gas turbine comprises a shroud integral type moving blade and a split ring. The moving blade includes a shroud provided from a leading edge of a tip of a moving blade to a trailing edge and whose outer side surface is provided with a seal fin. A radius of a tip end of the seal fin is substantially equal to a radius of a shroud trailing edge end. The split ring has a structure in which a radius of its inner peripheral surface is slightly larger than a radius of the seal fin tip end and the radius of the shroud trailing edge end.

19 Claims, 15 Drawing Sheets

SHROUD INTEGRAL TYPE MOVING BLADE AND SPLIT RING OF GAS TURBINE

FIELD OF THE INVENTION

The present invention relates to a shroud integral type moving blade and a split ring of a gas turbine which can prevent the leakage flow of a gas path (combustion gas main flow). It is noted that "blade midpoint" indicates a certain position from the leading edge of a blade to the trailing edge thereof in this specification.

BACKGROUND OF THE INVENTION

Generally, a gas turbine consists of a casing, a rotor which is attached rotatably to the casing, a plurality of stationary blades which are annularly arranged in the casing, and a plurality of moving blades which are annularly arranged in the rotor. The gas turbine produces power by the rotation of the moving blades and the rotor when combustion gas passes through the stationary blades and the moving blades.

A shroud integral type moving blade and a split ring of the gas turbine will be explained in detail with reference to FIGS. 17 and 18.

In FIG. 17, reference symbol 1 denotes a shroud integral type moving blade. The shroud integral type moving blade 1 is constituted so that a plate shroud (a tip shroud or a shroud cover) 3 is provided integrally with the tip of a moving blade 2. In FIG. 17, the shroud integral type moving blade 1 is on a rear stage side, e.g., in the third or fourth stage.

An inner side surface 4 of the shroud 3 is inclined along a gas path 5 which is indicated by an arrow of a solid line in FIG. 17. Namely, the radius of the inner side surface 4 of the shroud 3 (radius from the rotary shaft of the rotor) gradually increases from the upstream side of the gas path 5 to the downstream side thereof.

A seal fin 7 is provided integrally on an outer side surface 6 of the shroud 3. As shown in FIG. 18, the seal fin 7 is extended in the rotation direction of the shroud integral type moving blade 1 (indicated by a blank arrow in FIG. 18). In addition, the adjacent shrouds 3 are provided to be continuous to each other, whereby the seal fin 7 is shaped into a ring in the rotation direction of the shroud integral type moving blade 1. The ring-shaped seal fin 7 seals the outer side surface 6 of the shroud 3 from the flat inner peripheral surface 12 of a split ring 10 to be explained later, while facing the flat inner peripheral surface 12 of the split ring 10.

Contacts 8 are provided integrally on both ends of (the seal fin 7 of) the shroud 3, respectively. A contact surface 9 is provided on the outer side surface of each contact 8. As shown in FIG. 18, the contact surfaces 9 of the adjacent shrouds 3 frictionally abut on each other, whereby the shrouds 3 are provided continuous to each other.

The shroud integral type moving blade 1 functions as follows.

1. The sealing function of the seal fin 7 decreases pressure loss and leakage flow rate caused by the clearance between the blade 1 and the flat inner peripheral surface 12 of the split ring 10.
2. The reinforcing function of the shroud 3 integral with the tip of the moving blade 2 increases characteristic frequency and improves vibration intensity.
3. The function of the frictional abutment of the contact surfaces 9 enables increasing vibration damping.

In FIG. 17, reference symbol 10 denotes a split ring. The split ring 10 is arranged on the casing side to support stationary blades. The inner peripheral surface 11 of the split ring 10, similarly to the inner side surface 4 of the shroud 3, is inclined along the gas path 5. A part 12 on the inner peripheral surface 11 of the split ring 10, which faces the shroud integral type moving blade 1 is of a flat shape recessed outward.

In recent years, gas turbines which ensure high turbine efficiency and which have large capacity have been mainly employed. It, therefore, becomes necessary to increase work responsible for each blade of each step and the distance from the rotary shaft of the rotor to the tip of each moving blade (the radius of the tip of the moving blade) tends to be longer. Accordingly, a higher bending stress resulting from a centrifugal force acts on the shroud 3 of the shroud integral type moving blade 1.

As a result, it is necessary to suppress the high bending stress resulting from the centrifugal force and acting on the shroud 3 to an allowable value or below. To this end, the shroud 3 is cut from a state indicated by a two-dot chain line into a state indicated by a solid line (to have a winglet shape) so as to make the shroud 3 lighter in weight as shown in FIG. 18.

Nevertheless, if the shroud 3 is cut into a winglet shape, a void 14 is formed near a throat 13 after cutting the shroud 3 as shown in FIG. 18. This void 14 ranges widely as shown in FIG. 18.

Meanwhile, a large cavity cross-sectional area 15 (portion indicated by a two-dot chain line in FIG. 17) is formed between the outer side surface 6 of the shroud 3 and the flat inner peripheral surface 12 of the split ring 10 on the downstream side of the seal fin 7 in the conventional shroud integral type moving blade 1 and the conventional split ring 10.

Because of the large cavity cross-sectional area 15, leakage flows 16 and 17 (indicated by arrows of broken lines in FIGS. 17 and 18) occur from the gas path 5 in the conventional shroud integral type moving blade 1 and split ring 10, as shown in FIGS. 17 and 18.

The leakage flow 16, in particular, slips out of the gas path 5 through the void 14 near the throat 13, temporarily enters the cavity 15 between the shroud 3 and the split ring 10 and joins again with the gas path 5 from the cavity 15. On the other hand, the leakage flow 17 temporarily enters between the shroud 3 and the split ring 10 from the gas path 5. However, the leakage flow 17 is shut off by the seal fin 7.

As can be seen, much pressure loss occurs to the conventional shroud integral type moving blade 1 and split ring 10 since the leakage flow 16 interferes and mixes with the gas path 5. In addition, the leakage flow 16 shifts the efflux angle of the moving blade 2 (throat area S, see FIG. 3) from a design value. If the efflux angle is shifted from the design value, a pressure ratio and the degree of reaction are shifted from respective design values, resulting in the deterioration of efficiency.

SUMMARY OF THE INVENTION

It is an object of this invention to provide a shroud integral type moving blade and a split ring of a gas turbine which can prevent the leakage flow of a gas path.

The gas turbine according to one aspect of this invention comprises the shroud integral type moving blade and the split ring. The shroud integral type moving blade has a structure in which a shroud is provided from a leading edge of a tip of a moving blade to a trailing edge of the tip of the moving blade, and in which a radius of a seal fin tip end is substantially equal to a radius of a trailing edge of the shroud. The split ring has a structure in which a radius of its inner peripheral surface is slightly larger than a radius of the seal fin tip end and the radius of the trailing edge of the shroud to prevent a leakage flow of a gas path.

The gas turbine according to another aspect of this invention comprises the shroud integral type moving blade and the split ring. The shroud integral type moving blade has a structure in which a shroud is provided from a leading edge of a tip of a moving blade to a trailing edge of the tip of the moving blade, in which a flat section is provided on a trailing edge of the shroud and in which a radius of a seal fin tip end is substantially equal to a radius of the trailing edge of the shroud. The split ring has a structure in which a radius of its inner peripheral surface is slightly larger than a radius of the seal fin tip end and a radius of the flat section to prevent a leakage flow of a gas path.

The gas turbine according to still another aspect of this invention comprises the shroud integral type moving blade and the split ring. The shroud integral type moving blade has a structure in which a shroud is provided from a leading edge of a tip of a moving blade to halfway along a trailing edge of the tip of the moving blade, in which a flat section is provided on the trailing edge of the tip of the moving blade and in which a radius of a seal fin tip end is substantially equal to a radius of the flat section on the trailing edge. The split ring has a structure in which a radius of its inner peripheral surface is slightly larger than the radius of the seal fin tip end and the radius of the flat section on the trailing edge of the tip to prevent a leakage flow of a gas path.

The gas turbine according to still another aspect of this invention comprises the shroud integral type moving blade and the split ring. The shroud integral type moving blade has a structure in which a radius of a seal fin tip end is larger than a radius of a tip side of a shroud and a radius of a tip side of a moving blade. The split ring has a structure in which a step section is provided from a portion which faces the seal fin to a downward portion, in which a radius of an inner peripheral surface of the step section is slightly smaller than a radius of an inner peripheral surface of the portion which faces the seal fin and slightly larger than a radius of the tip side of the shroud and a radius of the tip side of the moving blade to prevent a leakage flow of a gas path.

The gas turbine according to still another aspect of this invention comprises the shroud integral type moving blade and the split ring. The shroud integral type moving blade has a structure in which a shroud is provided from a leading edge of a tip of a moving blade to a midpoint of the tip of the moving blade, in which a seal fin is provided at the midpoint of the tip of the moving blade, in which a flat section is provided from the midpoint of the tip of the moving blade to a trailing edge of the tip of the moving blade, and in which a radius of a seal fin tip end is substantially equal to a radius of the flat section. The split ring has a structure in which a radius of its inner peripheral surface is slightly larger than the radius of the seal fin tip end and the radius of the flat section to prevent a leakage flow of the gas path.

The gas turbine according to still another aspect of this invention comprises the shroud integral type moving blade and the split ring. The shroud integral type moving blade has a structure in which a shroud is provided from a leading edge of a tip of a moving blade to a midpoint of the tip of the moving blade, in which a seal fin is provided at the midpoint of the tip of the moving blade, in which a flat section is provided from the midpoint of the tip of the moving blade to a trailing edge of the tip of the moving blade, and in which a radius of a seal fin tip end is larger than a radius of the flat section of the tip. The split ring has a structure in which a step section is provided from a portion which faces the shroud to a downward portion, in which a radius of an inner peripheral surface of the step section is slightly smaller than a radius of an inner peripheral surface of the portion which faces the shroud to prevent a leakage flow of a gas path.

Other objects and features of this invention will become apparent from the following description with reference to the accompanying drawings.

DETAILED DESCRIPTION

Nine embodiments of the shroud integral type moving blade and the split ring according to the present invention will be explained hereinafter with reference to FIGS. 1 to 16. It is noted that the shroud integral type moving blade and the split ring are not limited by these embodiments.

Figure 17:
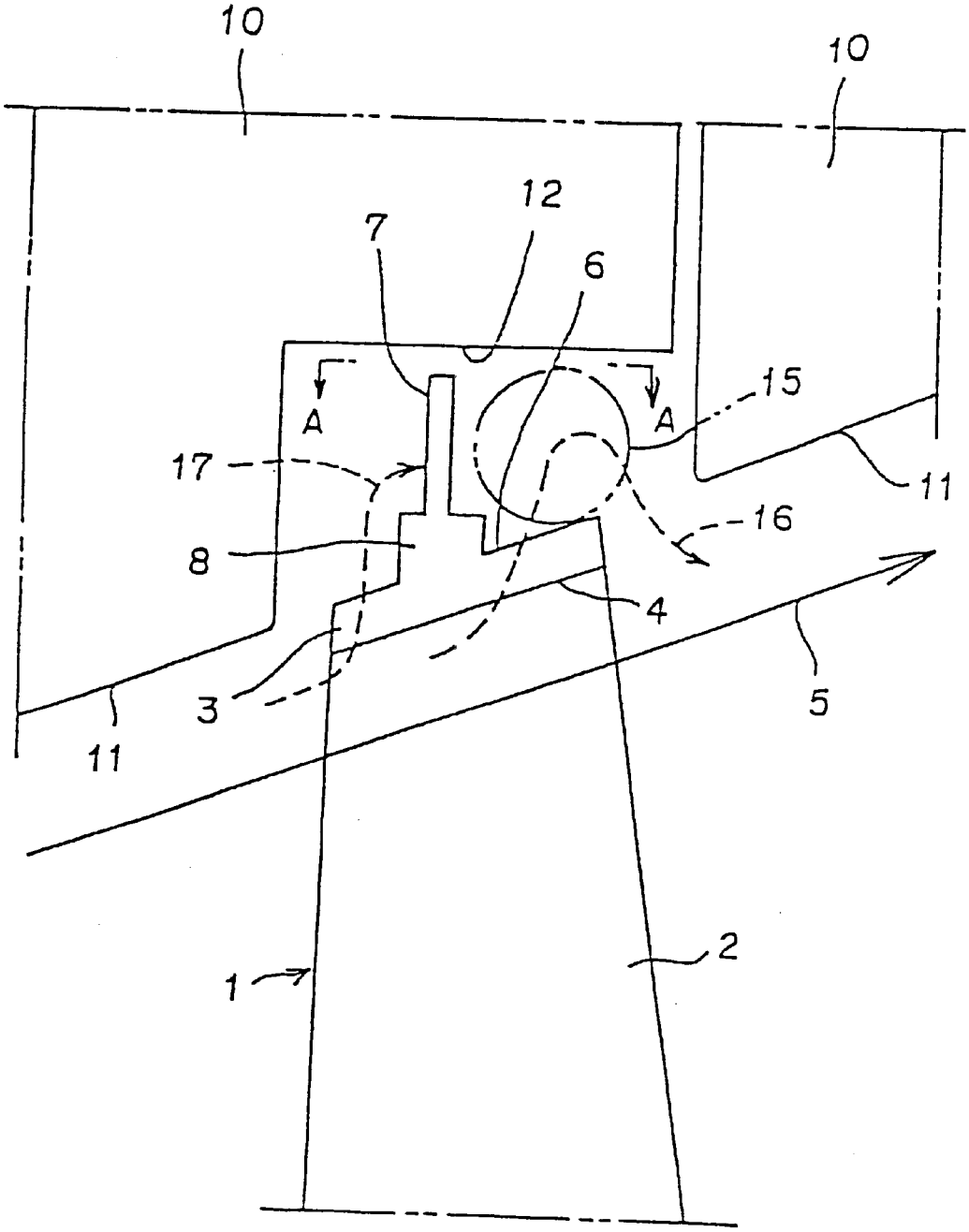
PRIOR ART FIG. 17
FIG. 17 is an explanatory view which shows a conventional shroud integral type moving blade and a conventional split ring, and is a perspective view when viewed from an arrow B shown in FIG. 18.
Figure 18:
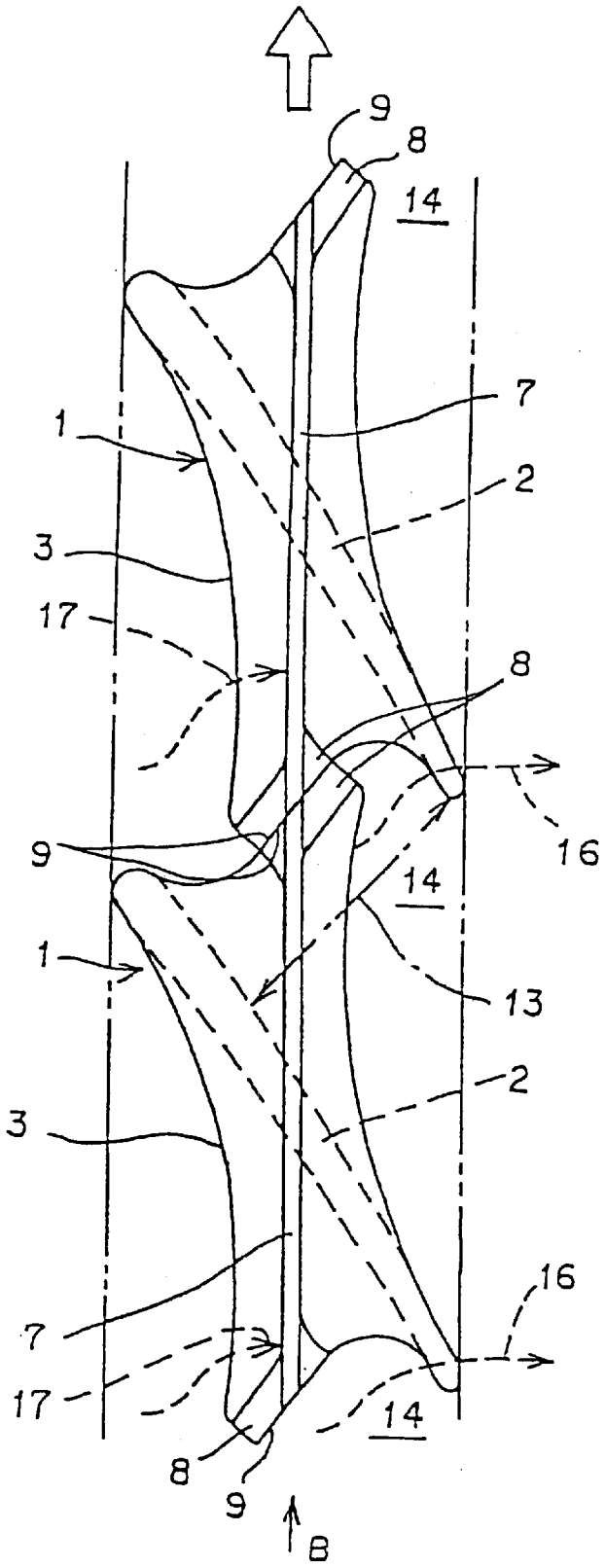
FIG. 18 PRIOR ART
FIG. 18 is a perspective view taken along line A—A shown in FIG. 17.

A first embodiment of this invention will be explained below. FIGS. 1 to 4 show the first embodiment of the shroud integral type moving blade and the split ring according to the present invention. In the figures, the same reference symbols as those in FIGS. 17 and 18 denote the same elements, respectively.

A gas turbine in the first embodiment includes a shroud integral type moving blade 100 and a split ring 105. The inner side surface 4 of a shroud 3 is inclined along a gas path 5. A seal fin 7 which seals the outer side surface 6 of the shroud 3 from the inner peripheral surface 106 of the split ring 105 while facing the inner peripheral surface 106 of the split ring 105, is provided on the outer side surface 6 of the shroud 3.

Figure 1:
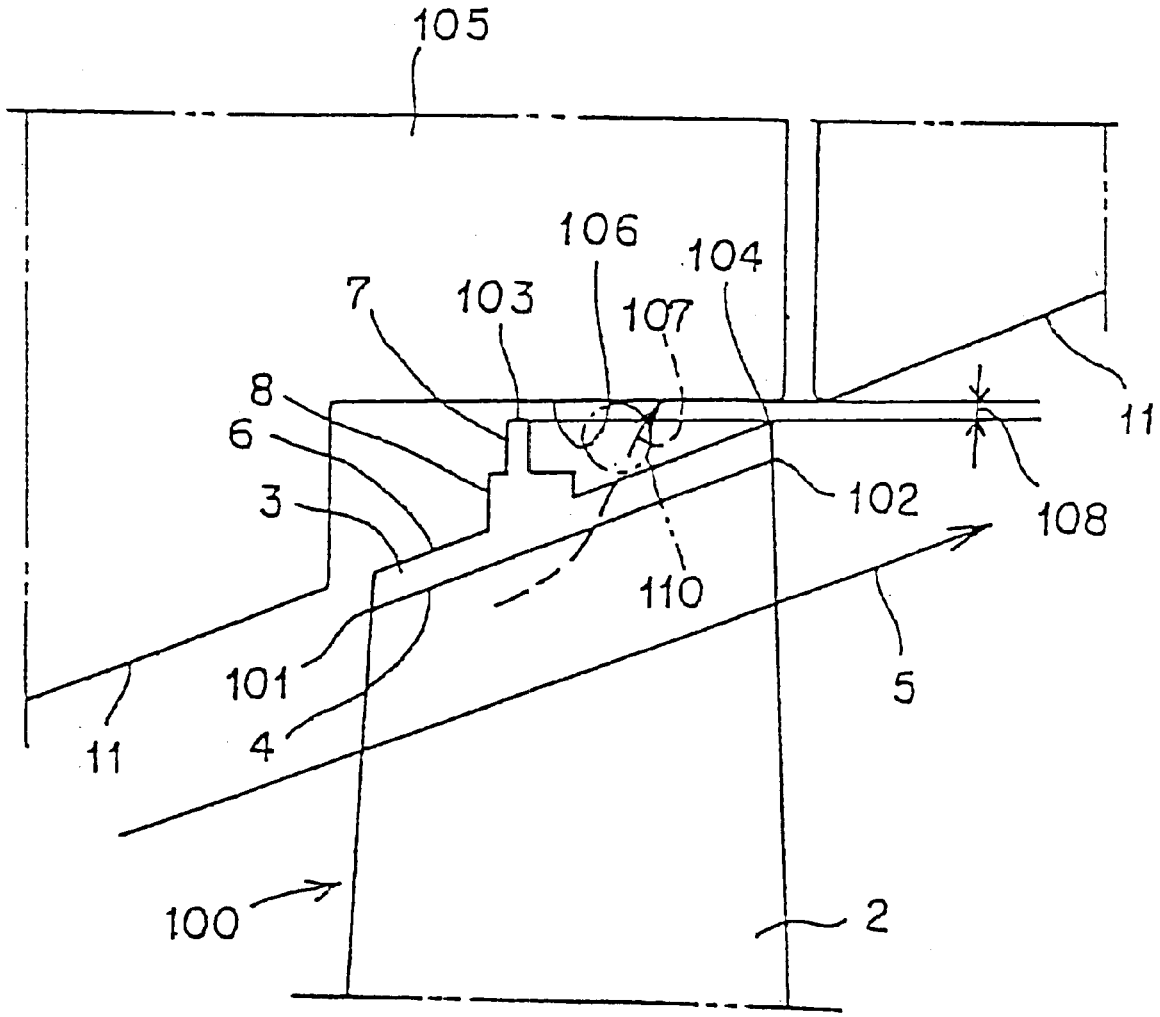
FIG. 1 is an explanatory view which shows a first embodiment of the shroud integral type moving blade and the split ring according to the present invention.
Figure 2:
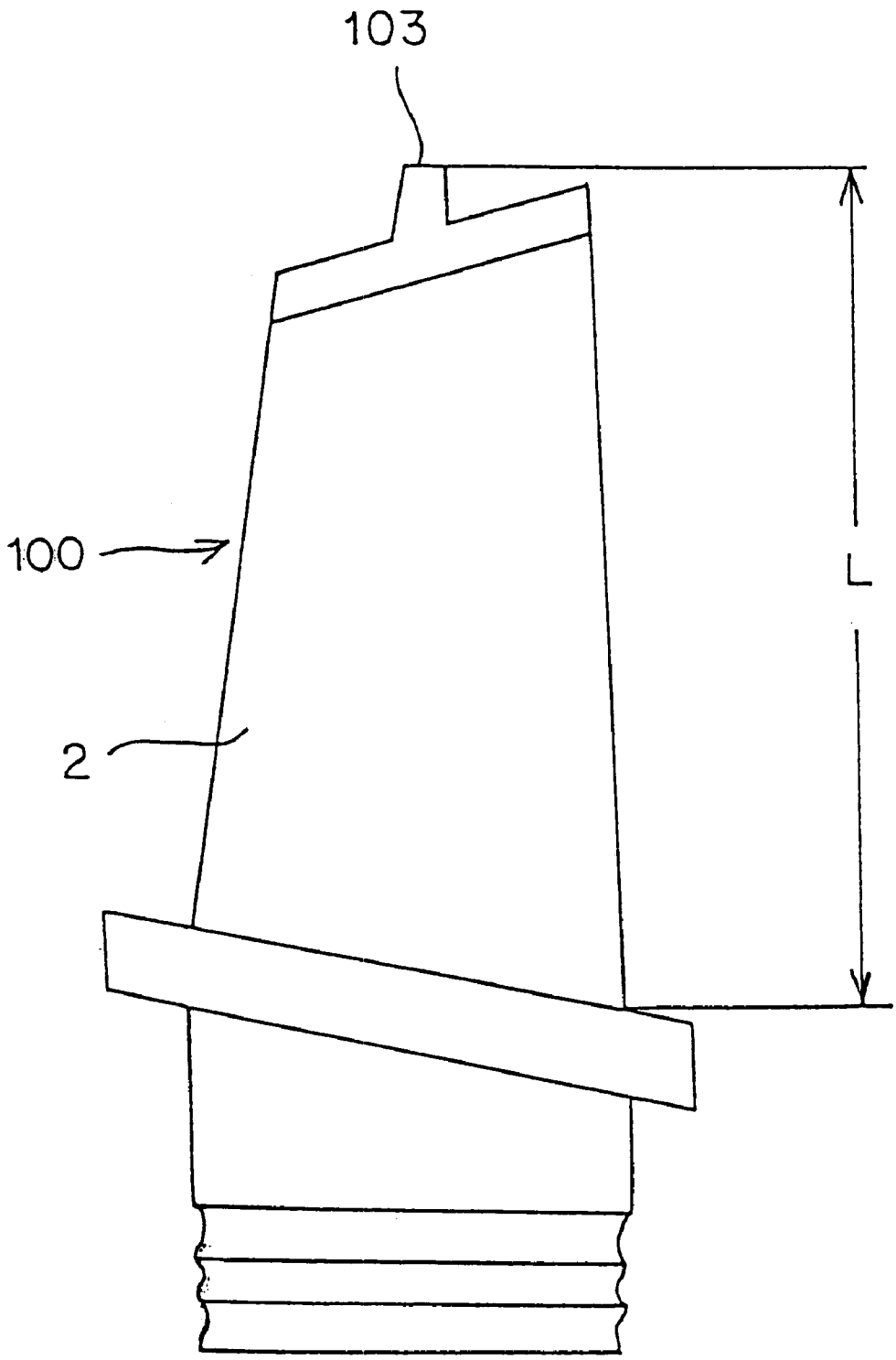
FIG. 2 is an explanatory view which shows a length given by subtracting the hub radius of a moving blade trailing edge from the height of a seal fin tip end in the first embodiment.
Figure 3:
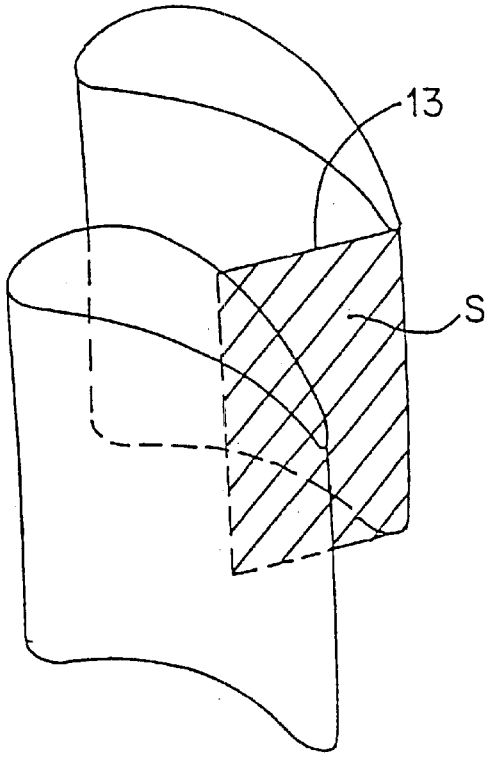
FIG. 3 is an explanatory view which shows the area of a throat in the first embodiment.
Figure 4:
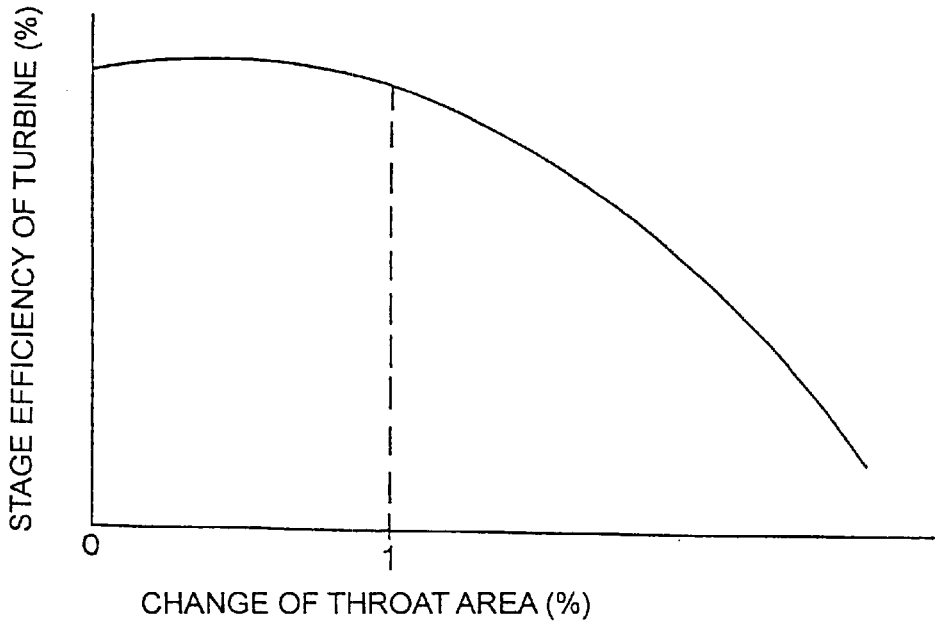
FIG. 4 is an explanatory view which shows the relative relationship of the stage efficiency of a turbine to the change of the throat area in the first embodiment.

The shroud integral type moving blade 100 has the following structure. The shroud 3 is provided to spread from the leading edge 101 of the tip of the moving blade 2 to the trailing edge 102 thereof. The radius of a seal fin tip end 103 is substantially equal to that of the end 104 of a shroud trailing edge. "Substantially equal" means herein that the following expression is satisfied, {(the height of the seal fin tip end 103)−(the end 104 of the shroud trailing edge)}/{(the height of the seal fin tip end 103)−(the hub radius of the trailing edge of the moving blade 2)}<1%. In this expression, the denominator {(the height of the seal fin tip end 103)−(the hub radius of the trailing edge of the moving blade 2)} is equal to a length L which is given by subtracting the hub radius of the trailing edge of the moving blade 2 from the height of the seal fin tip end 103 as shown in FIG. 2. This expression means that an error between the design value of a throat area S (which is the area of a throat 13 and which is the area of a rectangle indicated by slashes in FIG. 3) and an actual throat area S is set to fall within 1%. This expression is based on the fact that if the throat area has a change of not more than 1%, it is possible to suppress the deterioration of the stage efficiency of the turbine as much as possible.

The split ring 105 has a structure in which the radius of the inner peripheral surface (flat inner peripheral surface) 106 of the split ring 105 is slightly larger than that of the seal fin tip end 103 and that of the shroud trailing edge end 104, for preventing the leakage flow 107 of the gas path 5.

In the first embodiment, a clearance 108 between the seal fin tip end 103 and the shroud trailing edge end 104 of the shroud integral type moving blade 100 and the inner peripheral surface 106 of the split ring 105 can be set small to such an extent that the tip end 103 and the end 104 do not contact with the inner peripheral surface 106 even if they are thermally elongated.

Consequently, in the first embodiment, it is possible to decrease a cavity cross-sectional area 110 (which is a portion indicated by a two-dot chain line in FIG. 1) which is present between the outer side surface 6 of the shroud 3 and the inner peripheral surface 106 of the split ring 105 on the downstream side of the seal fin 7, in accordance with the clearance 108. Therefore, the leakage flow 107 which slips out of the gas path 5 through a void near the throat 13 is shut off by the inner peripheral surface 106 of the split ring 105. As is obvious from the above, even if a winglet type shroud 3 is employed, it is possible to prevent the leakage flow 107 of the gas path 5. In other words, the leakage flow 107 of the gas path 5 through the clearance 108 causes the deterioration of turbine efficiency. In the first embodiment, however, by minimizing the clearance 108, it is possible to suppress the deterioration of the turbine efficiency as much as possible.

Figure 5:
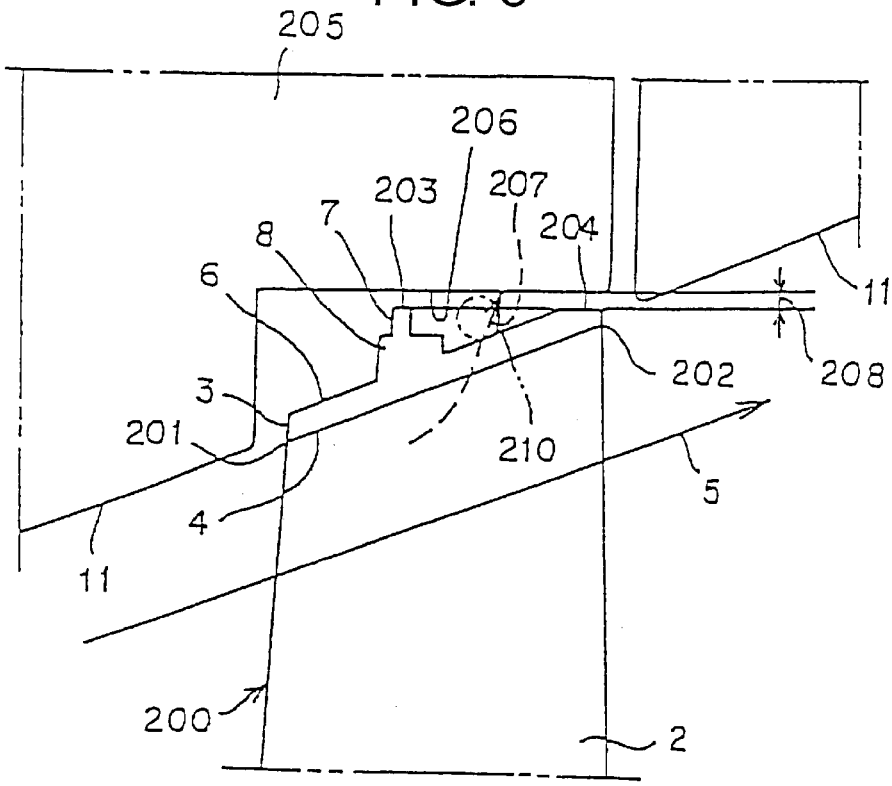
FIG. 5 is an explanatory view which shows a second embodiment of the shroud integral type moving blade and the split ring according to the present invention.
Figure 6:
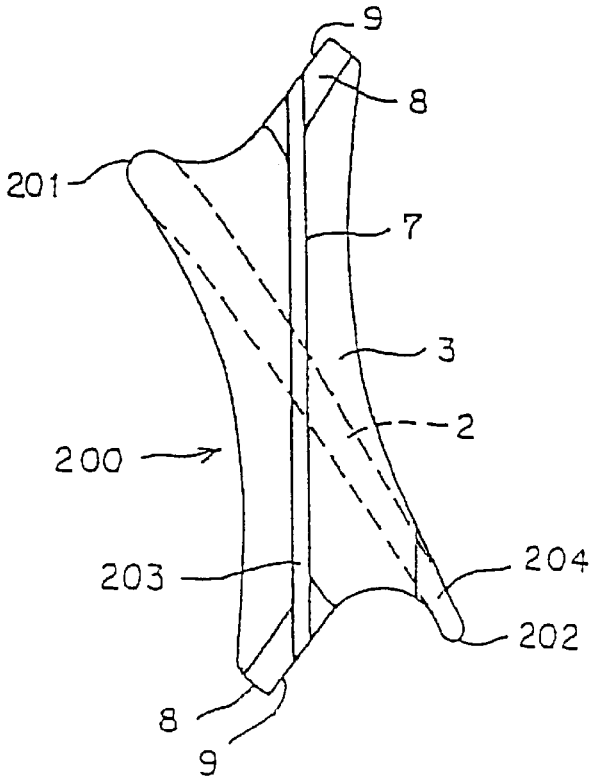
FIG. 6 is a plan view of the shroud integral type moving blade in the second embodiment.

A second embodiment of the present invention will be explained below. FIGS. 5 and 6 show the second embodiment of the shroud integral type moving blade and the split ring according to the present invention. In FIGS. 5 and 6, the same reference symbols as those shown in FIGS. 1 to 4, FIG. 17 and FIG. 18 denote the same elements, respectively. Therefore, these elements will not be explained herein.

A shroud integral type moving blade 200 has the following structure. The shroud 3 is provided from the leading edge 201 of the tip of a moving blade 2 to the trailing edge 202 thereof. A flat section 204 is provided on the trailing edge of the shroud 3. The radius of a seal fin tip end 203 is substantially equal to that of the flat section 204 of the shroud trailing edge. "Substantially equal" means herein that the following expression is satisfied, {(the height of the seal fin tip end 203)−(the flat section 204 of the shroud trailing edge)}/{(the height of the seal fin tip end 203)−(the hub radius of the trailing edge of the moving blade 2)}<1%. This expression is based on the same fact already explained above.

A split ring 205 has the following structure. The radius of the inner peripheral surface (flat inner peripheral surface) 206 of the split ring 205 is slightly larger than that of the seal fin tip end 203 and that of the flat section 204 of the shroud trailing edge. The leakage flow 207 of the gas path 5 is thereby prevented.

In the second embodiment, a clearance 208 between the seal fin tip end 203 and the flat section 204 of the shroud trailing edge of the shroud integral type moving blade 200 and the inner peripheral surface 206 of the split ring 205 can be set small to such an extent that the tip end 203 and the flat section 204 do not contact with the inner peripheral surface 206 even if they are thermally elongated.

Consequently, in the second embodiment, similarly to the first embodiment, it is possible to decrease a cavity cross-sectional area 210 (which is a portion indicated by a two-dot chain line in FIG. 5) which is present between the outer side surface 6 of the shroud 3 and the inner peripheral surface 206 of the split ring 205 on the downstream side of the seal fin 7, in accordance with the clearance 208. Therefore, the leakage flow 207 which slips out of the gas path 5 through a void near a throat is shut off by the inner peripheral surface 206 of the split ring 205. As can be seen, even if a winglet type shroud 3 is employed, it is possible to prevent the leakage flow 207 of the gas path 5. In other words, the leakage flow 207 of the gas path 5 through the clearance 208 causes the deterioration of turbine efficiency. However, it is possible to suppress the deterioration of the turbine efficiency as much as possible by minimizing the clearance 208.

In the second embodiment, in particular, the flat section 204 of the shroud trailing edge enables the shroud 3 to be made lighter in weight. Further, even if the rotor is thermally elongated by, for example, 10 to 20 mm in an axial direction, the small cavity cross-sectional area is kept as it is.

Figure 7:
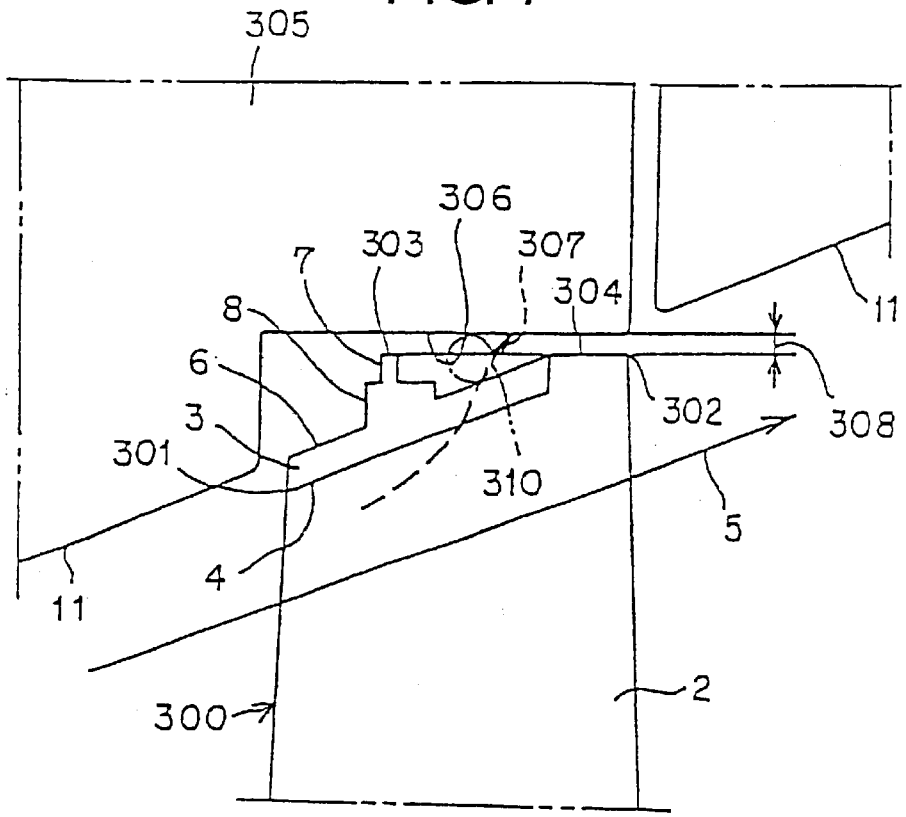
FIG. 7 is an explanatory view which shows a third embodiment of the shroud integral type moving blade and the split ring according to the present invention.
Figure 8:
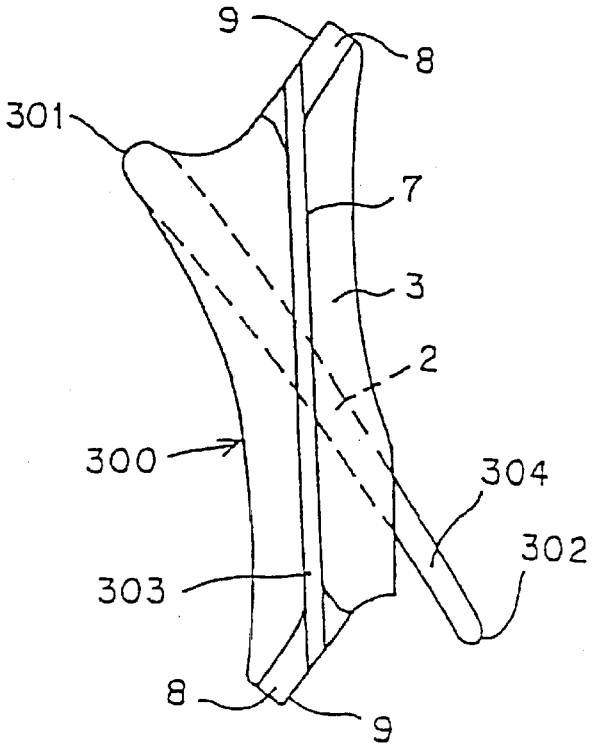
FIG. 8 is a plan view of the shroud integral type moving blade in the third embodiment.

A third embodiment of this invention will be explained below. FIGS. 7 and 8 show the third embodiment of the shroud integral type moving blade and the split ring according to the present invention. In FIGS. 7 and 8, the same reference symbols as those in FIGS. 1 to 6, FIG. 17 and FIG. 18 denote the same elements, respectively. These elements will not be, therefore, explained herein.

A shroud integral type moving blade 300 has the following structure. The shroud 3 is provided from the leading edge 301 of the tip of the moving blade 2 to halfway along the trailing edge 302 thereof. A flat section 304 is provided on the trailing edge of the tip of the moving blade 2. The radius of a seal fin tip end 303 is substantially equal to that of the flat section 304 on the trailing edge of the tip of the moving blade 2. "Substantially equal" means herein that the following expression is satisfied, {(the height of the seal fin tip end 303)−(the flat section 304 of the shroud trailing edge)}/{(the height of the seal fin tip end 303)−(the hub radius of the trailing edge of the moving blade 2)}<1%. This expression is based on the same fact already explained above.

A split ring 305 has the following structure. The radius of the inner peripheral surface (flat inner peripheral surface) 306 of the split ring 305 is slightly larger than that of the seal fin tip end 303 and that of the flat section 304 of the tip trailing edge. The leakage flow 307 of the gas path 5 is thereby prevented.

In the third embodiment, a clearance 308 between the seal fin tip end 303 and the flat section 304 of the tip trailing edge of the shroud integral type moving blade 300 and the inner peripheral surface 306 of the split ring 305 can be set small to such an extent that the tip end 303 and the flat section 304 do not contact with the inner peripheral surface 306 even if they are thermally elongated.

Consequently, in the third embodiment, similarly to the first and second embodiments, it is possible to decrease a cavity cross-sectional area 310 (which is a portion indicated by a two-dot chain line in FIG. 7) which is present between the outer side surface 6 of the shroud 3 and the inner peripheral surface 306 of the split ring 305 on the downstream side of the seal fin 7, in accordance with the clearance 308. Therefore, the leakage flow 307 which slips out of the gas path 5 through a void near a throat is shut off by the inner peripheral surface 306 of the split ring 305. As can be seen, even if a winglet type shroud 3 is employed, it is possible to prevent the leakage flow 307 of the gas path 5. In other words, the leakage flow 307 of the gas path 5 through the clearance 308 causes the deterioration of turbine efficiency. However, it is possible to suppress the deterioration of the turbine efficiency as much as possible by minimizing the clearance 308.

In the third embodiment, in particular, similarly to the second embodiment, the flat section 304 of the tip trailing edge 302 enables the shroud 3 to be made lighter in weight. Further, even if the rotor is thermally elongated by, for example, 10 to 20 mm in an axial direction, the small cavity cross-sectional area is kept as it is.

Moreover, in the third embodiment, the shroud 3 has no portion which corresponds to the trailing edge 302 on the tip of the moving blade 2. It is possible to make the shroud 3 lighter in weight while keeping the strength of the shroud, accordingly.

Figure 9:
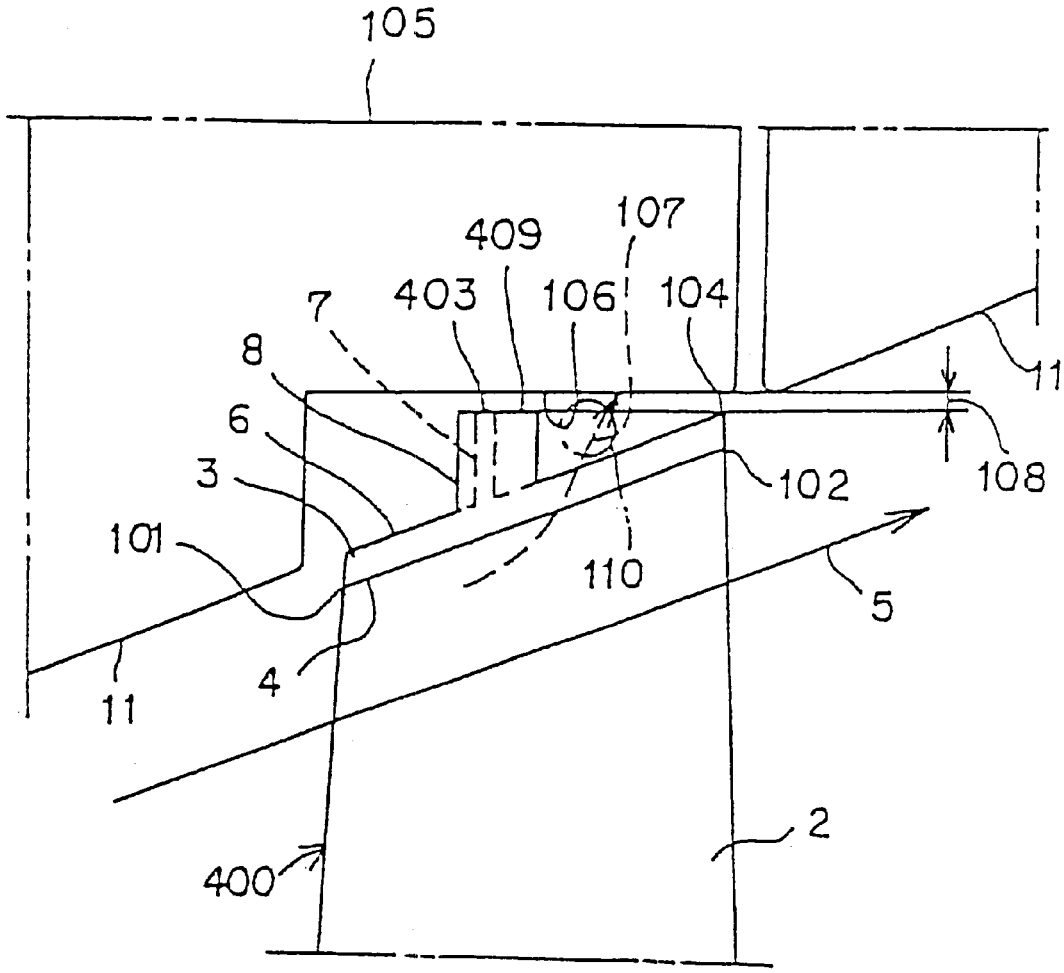
FIG. 9 is an explanatory view which shows a fourth embodiment of the shroud integral type moving blade and the split ring according to the present invention.

A fourth embodiment of this invention will be explained below. FIG. 9 shows the fourth embodiment of the shroud integral type moving blade and the split ring according to the present invention. In FIG. 9, the same reference symbols as those in FIGS. 1 to 8, FIG. 17 and FIG. 18 denote the same elements, respectively. These elements will not be, therefore, explained herein.

A shroud integral type moving blade 400 in the fourth embodiment is a modification of the shroud integral type moving blade 100 in the first embodiment. That is, the shroud integral type moving blade 400 in this embodiment has a structure in which the radius of a seal fin tip end 403 is substantially equal to that of a contact tip end 409 and in which the surface of the seal fin tip end 403 is flush with that of the contact tip end 409.

The shroud integral type moving blade 400 in the fourth embodiment has the following structure. The radius of the seal fin tip end 403 and that of the contact tip end 409 are substantially equal to that of the end 104 of a shroud trailing edge. "Substantially equal" means herein that the following expression is satisfied, {(the height of the seal fin tip end 403 and the contact tip end 409)−(the end 104 of the shroud trailing edge)}/{(the height of the seal fin tip end 403 and the contact tip end 409)−(the hub radius of the trailing edge 102 of the moving blade 2)}<1%. This expression is based on the same fact already explained above. Further, the shroud integral type moving blade 400 in the fourth embodiment has a structure in which the contacts 8 are provided on both ends of the seal fin 7, respectively and in which the contact surfaces (9) of the adjacent contacts 8 frictionally abut on each other.

In the fourth embodiment, the height of each contact 8 is increased to be equal to that of the seal fin 7 and the surface of the seal fin tip end 403 is made flush with that of the contact tip end 409. It is, therefore, possible to improve the strength of the shroud 3 while keeping the shroud 3 light in weight.

Figure 10:
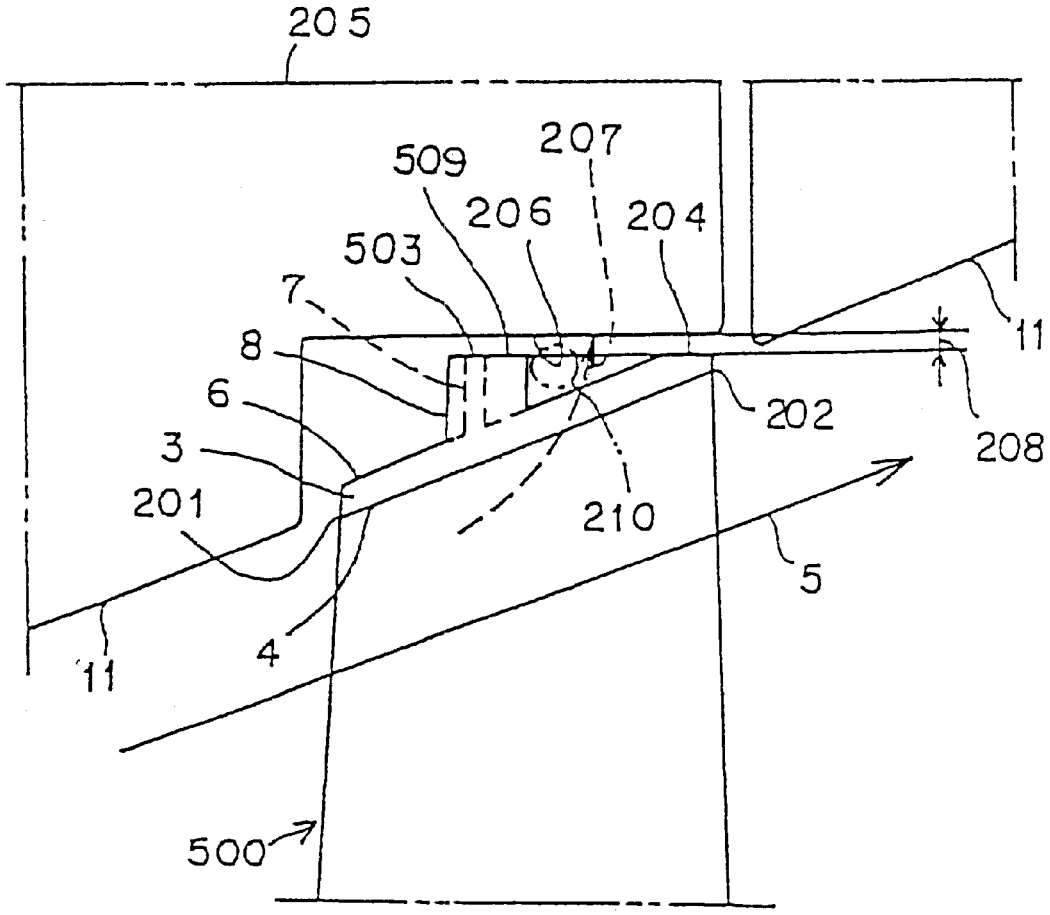
FIG. 10 is an explanatory view which shows a fifth embodiment of the shroud integral type moving blade and the split ring according to the present invention.

A fifth embodiment of this invention will be explained below. FIG. 10 shows a fifth embodiment of the shroud integral type moving blade and the split ring according to the present invention. In FIG. 10, the same reference symbols as those in FIGS. 1 to 9, FIG. 17 and FIG. 18 denote the same elements, respectively. These elements will not be, therefore, explained herein.

A shroud integral type moving blade 500 in the fifth embodiment is a modification of the shroud integral type moving blade 200 in the second embodiment. That is, the shroud integral type moving blade 500 in this embodiment has the following structure. The radius of a seal fin tip end 503 is substantially equal to that of a contact tip end 509, and the surface of the seal fin tip end 503 is made flush with that of the contact tip end 509.

In the shroud integral type moving blade 500 in the fifth embodiment, the radius of the seal fin tip end 503 and that of the contact tip end 509 are substantially equal to that of the flat section 204 of the shroud trailing edge. "Substantially equal" means herein that the following expression is satisfied, {(the height of the seal fin tip end 503 and the contact tip end 509)−(the flat section 204 of the shroud trailing edge)}/{(the height of the seal fin tip end 503 and the contact tip end 509)−(the hub radius of the trailing edge of the moving blade 2)}<1%. This expression is based on the same fact already explained above. Further, the shroud integral type moving blade 500 in the fifth embodiment has a structure in which the contacts 8 are provided on both ends of the seal fin 7, respectively and in which the contact surfaces (9) of the adjacent contacts 8 frictionally abut on each other.

In the fifth embodiment, similarly to the fourth embodiment, the height of each contact 8 is increased to be equal to that of the seal fin 7 and the surface of the seal fin tip end 503 is made flush with that of the contact tip end 509. It is, therefore, possible to improve the strength of the shroud 3 while keeping the shroud 3 light in weight.

Figure 11:
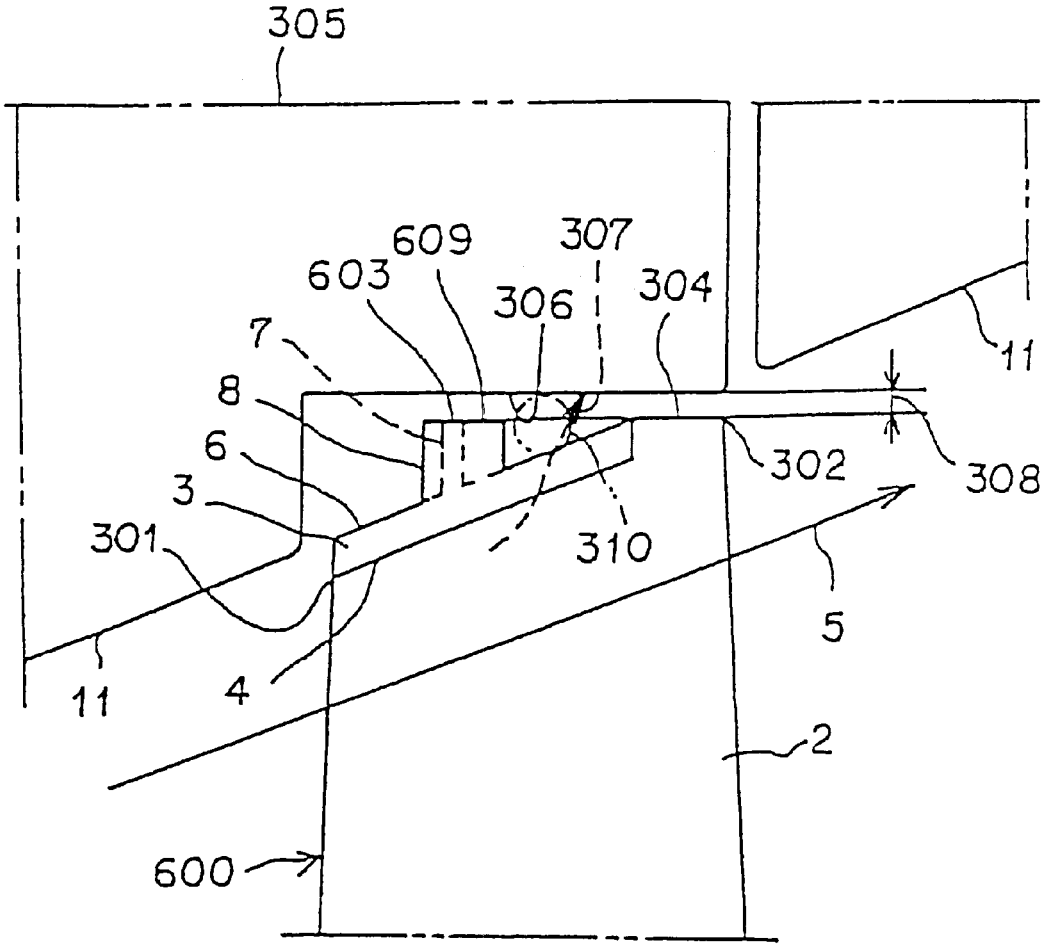
FIG. 11 is an explanatory view which shows a sixth embodiment of the shroud integral type moving blade and the split ring according to the present invention.

A sixth embodiment of this invention will be explained below. FIG. 11 shows the sixth embodiment of the shroud integral type moving blade and the split ring according to the present invention. In FIG. 11, the same reference symbols as those in FIGS. 1 to 10, FIG. 17 and FIG. 18 denote the same elements, respectively. These elements will not be, therefore, explained herein.

A shroud integral type moving blade 600 in the sixth embodiment is a modification of the shroud integral type moving blade 300 in the third embodiment. Namely, the shroud integral type moving blade 600 in this embodiment has a structure in which the radius of a seal fin tip end 603 is substantially equal to that of a contact tip end 609 and in which the surface of the seal fin tip end 603 is flush with that of the contact tip end 609.

The shroud integral type moving blade 600 in the sixth embodiment has the following structure. The radius of the seal fin tip end 603 and that of the contact tip end 609 are substantially equal to that of the flat section 304 of a tip trailing edge. "Substantially equal" means herein that the following expression is satisfied, {(the height of the seal fin tip end 603 and the contact tip end 609)−(the flat section 304 of the tip trailing edge)}/{(the height of the seal fin tip end 603 and the contact tip end 609)−(the hub radius of the trailing edge of the moving blade 2)}<1%. This expression is based on the same fact already explained above. Further, the shroud integral type moving blade 600 in the sixth embodiment has a structure in which the contacts 8 are provided on both ends of the seal fin 7, respectively and in which the contact surfaces (9) of the adjacent contacts 8 frictionally abut on each other.

In the sixth embodiment, similarly to the fourth and fifth embodiments, the height of each contact 8 is increased to be equal to that of the seal fin 7 and the surface of the seal fin tip end 603 is made flush with that of the contact tip end 609. It is, therefore, possible to improve the strength of the shroud 3 while keeping the shroud 3 light in weight.

Figure 12:
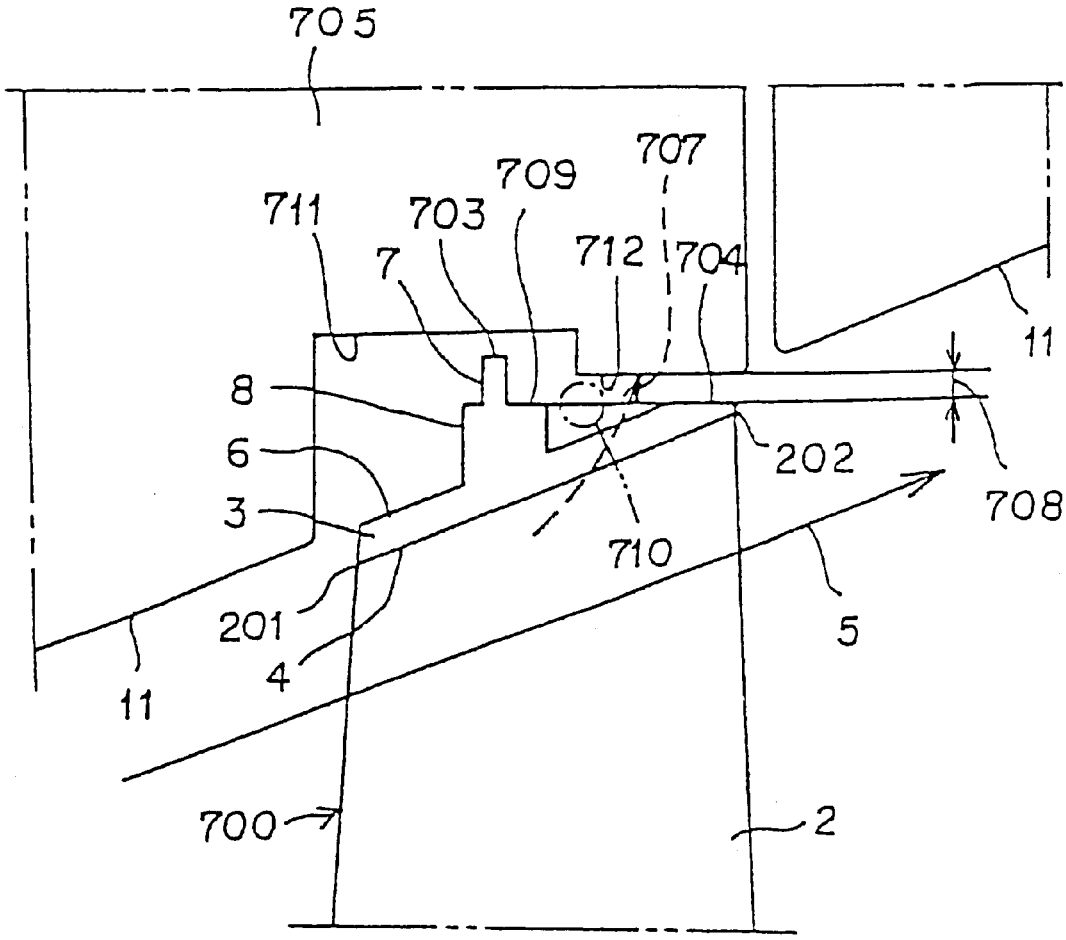
FIG. 12 is an explanatory view which shows a seventh embodiment of the shroud integral type moving blade and the split ring according to the present invention.

A seventh embodiment of this invention will be explained below. FIG. 12 shows the seventh embodiment of the shroud integral type moving blade and the split ring according to the present invention. In FIG. 12, the same reference symbols as those in FIGS. 1 to 11, FIG. 17 and FIG. 18 denote the same elements, respectively. These elements will not be, therefore, explained herein.

A shroud integral type moving blade 700 has the following structure almost similar to that of the shroud integral type moving blade 200 in the second embodiment shown in FIGS. 5 and 6. The shroud 3 is provided from the leading edge 201 of the tip of the moving blade 2 to the trailing edge 202 thereof. A flat section 704 is provided on the trailing edge of the shroud 3. In addition, this shroud integral type moving blade 700 has a structure in which the radius of a seal fin tip end 703 is larger than that of the tip side of the shroud 3 and the moving blade 2, for example, that of a contact tip end 709 and that of the flat section 704 on the shroud trailing edge.

A split ring 705 has the following structure. A step section 712 is provided from a section 711 which faces the seal fin 7 to a portion downstream of the section 711. The radius of the inner peripheral surface of the step section 712 is slightly smaller than that of the inner peripheral surface of the portion 711 which faces the seal fin, and slightly larger than the radius of the contact tip end 709 and the radius of the flat section 704 of the shroud trailing edge. A leakage flow 707 of the gas path 5 is thereby prevented.

In the seventh embodiment, a clearance 708 between the contact tip end 709 and the end 704 of the shroud trailing edge of the moving blade 700 and the inner peripheral surface of the step section 712 of the split ring 705 can be set small to such an extent that the contact tip end 709 and the end 704 do not contact with the inner peripheral surface of the step section 712 even if they are thermally elongated.

Consequently, in the seventh embodiment, it is possible to decrease a cavity cross-sectional area 710 (which is a portion indicated by a two-dot chain line in FIG. 12) which is present between the outer side surface 6 of the shroud 3 and the inner peripheral surface of the step section 712 of the split ring 705 on the downstream side of the seal fin 703. In the seventh embodiment therefore, similarly to the preceding first to sixth embodiments, the leakage flow 707 of the gas path 5 can be prevented. That is, since the leakage flow 707 of the gas path 5 from the clearance 708 causes the deterioration of turbine efficiency, by minimizing the clearance 708, it is possible to suppress the deterioration of the turbine efficiency as much as possible.

The technique explained in the seventh embodiment is applicable to shroud integral type moving blades of the following structures, respectively. A shroud integral type moving blade, almost similarly to the shroud integral type moving blade 100 in the first embodiment shown in FIGS. 1 to 4, which has a structure in which the shroud 3 is provided from the leading edge 101 on the tip of the moving blade 2 to the trailing edge 102 thereof. A shroud integral type moving blade, almost similarly to the shroud integral type moving blade 300 in the third embodiment shown in FIGS. 7 and 8, which has a structure in which the shroud 3 is provided from the leading edge 301 of the tip of the moving blade 2 to halfway along the trailing edge 302 thereof and in which the flat section 304 is provided on the tip trailing edge of the moving blade 3. Shroud integral type moving blades, almost similarly to the shroud integral type moving blades 400, 500 and 600 in the fourth to sixth embodiments shown in FIGS. 9 to 11, which have structures in which the radiuses of the seal fin tip ends 403, 503 and 603 are substantially equal to those of the contact tip ends 409, 509 and 609, respectively, and in which the surfaces of the seal fin tip ends 403, 503 and 603 are flush with those of the contact tip ends 409, 509 and 609, respectively.

Moreover, the technique explained in the seventh embodiment is also applicable to the structure of a shroud integral type moving blade in which the inner side surface 4 of the shroud 3 is not inclined along the gas path 5, e.g., the structure of a shroud integral type moving blade in which the inner side surface 4 of the shroud 3 is substantially parallel to a rotor shaft.

An eighth embodiment of this invention will be explained below. FIGS. 13A, 13B to 15 show the eighth embodiment of the shroud integral type moving blade and the split ring according to the present invention. In the figures, the same reference symbols as those in FIGS. 1 to 12, FIG. 17 and FIG. 18 denote the same elements, respectively. These elements will not be, therefore, explained herein.

A shroud integral type moving blade 800 has the following structure. The shroud 3 is provided from the leading edge 801 of the tip of the moving blade 2 to the midpoint of the tip of the moving blade 2. The seal fin 7 is provided at the midpoint of the tip of moving blade 2. A flat section 804 is provided from the midpoint of the tip of the moving blade 2 to the trailing edge 802 thereof. The radius of a seal fin tip end 803 is substantially equal to that of the tip flat section 804. "Substantially equal" means herein that the following expression is satisfied, {(the height of the seal fin tip end 803)−(the tip flat section 804)}/{(the height of the seal fin tip end 803)−(the hub radius of the trailing edge of the moving blade 2)}<1%. This expression is based on the same fact already explained above.

The shroud integral type moving blade 800 has the following structure. A rib 811 as well as the seal fin 7 and the contact 8 is provided on the peripheral edge of the shroud 3. The radius of a rib tip end 812 is substantially equal to that of the seal fin tip end 803 and that of a contact tip end 809. The surface of the rib tip end 812, that of the seal fin tip end 803 and that of the contact tip end 809 are flush with one another.

A split ring 805 has the following structure. The radius of an inner peripheral surface 806 of the split ring 805 is slightly larger than those of the seal fin tip end 803, the tip flat section 804, the contact tip end 809 and the rib tip end 812. A leakage flow 807 of the gas path 5 is thereby prevented.

In the eighth embodiment, a clearance 808 between the seal fin tip end 803, the tip flat section 804, the contact tip end 809 and the rib tip end 812 of the moving blade 800 and the inner peripheral surface 806 of the split ring 805 can be set small to such an extent that the seal fin tip end 803, the tip flat section 804, the contact tip end 809 and the rib tip end 812 do not contact with the inner peripheral surface 806 even if they are thermally elongated.

Consequently, in the eighth embodiment, it is possible to decrease a cavity cross-sectional area 810 which is present between the seal fin 7 and the tip flat section 804 downstream of the seal fin 7 and the inner peripheral surface 806 of the split ring 805 because of this structure. Therefore, similarly to the preceding first to seventh embodiments, in the eighth embodiment, the leakage flow 807 of the gas path 5 can be prevented. That is, since the leakage flow 807 of the gas path 5 from the clearance 808 causes the deterioration of turbine efficiency, by minimizing the clearance 808, it is possible to suppress the deterioration of the turbine efficiency as much as possible.

In the eighth embodiment, in particular, the shroud 3 does not have a portion which spreads from the tip midpoint of the moving blade 2 to the tip trailing edge 802 thereof. It is possible to make the shroud 3 light in weight while keeping the strength of the shroud 3, accordingly.

Furthermore, in the eighth embodiment, the rib 811 as well as the seal fin 7 and the contact 8 is provided on the peripheral edge of the shroud 3. It is, therefore, possible to improve the strength of the shroud 3 while keeping the shroud 3 light in weight.

Figure 13A:
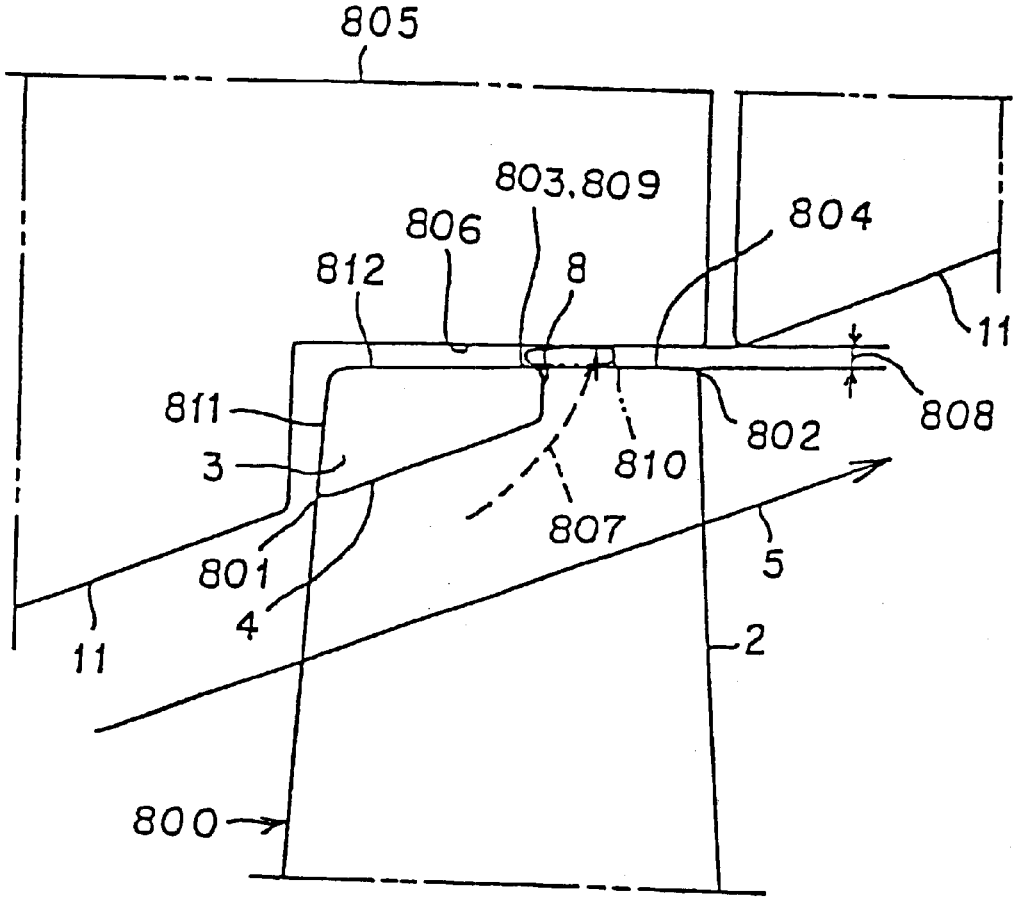
FIG. 13A is an explanatory view which shows an eighth embodiment of the shroud integral type moving blade and the split ring according to the present invention.
Figure 13B:
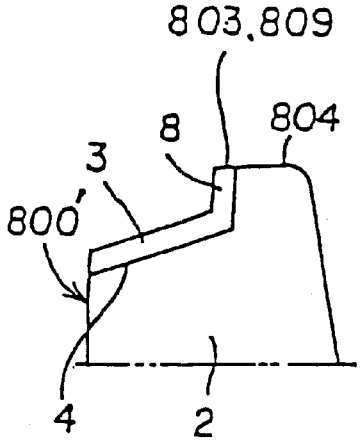
FIG. 13B is a partially explanatory view which shows a modification of the eighth embodiment.
Figure 14:
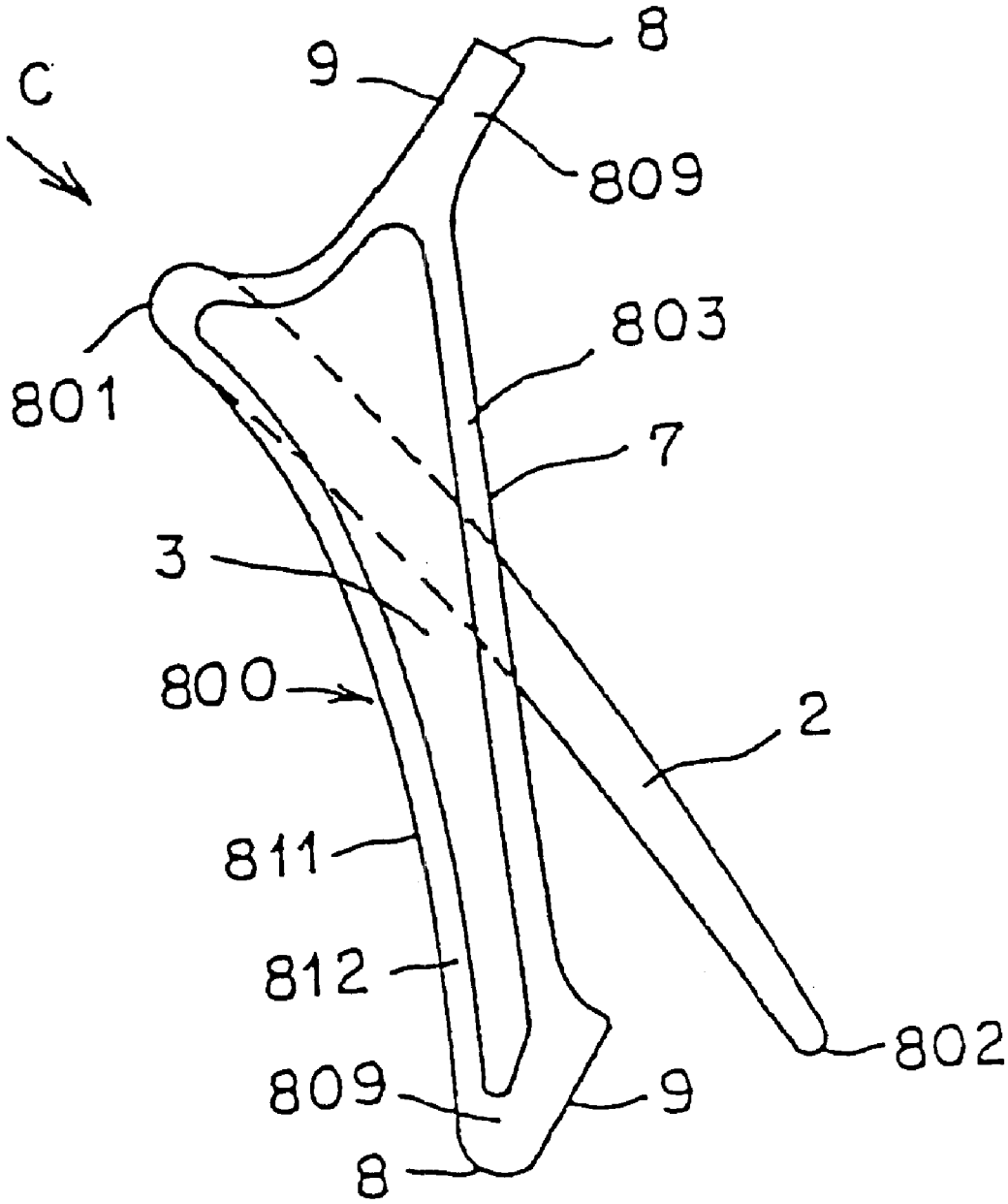
FIG. 14 is a plan view of the shroud integral type moving blade in the eighth embodiment.
Figure 15:
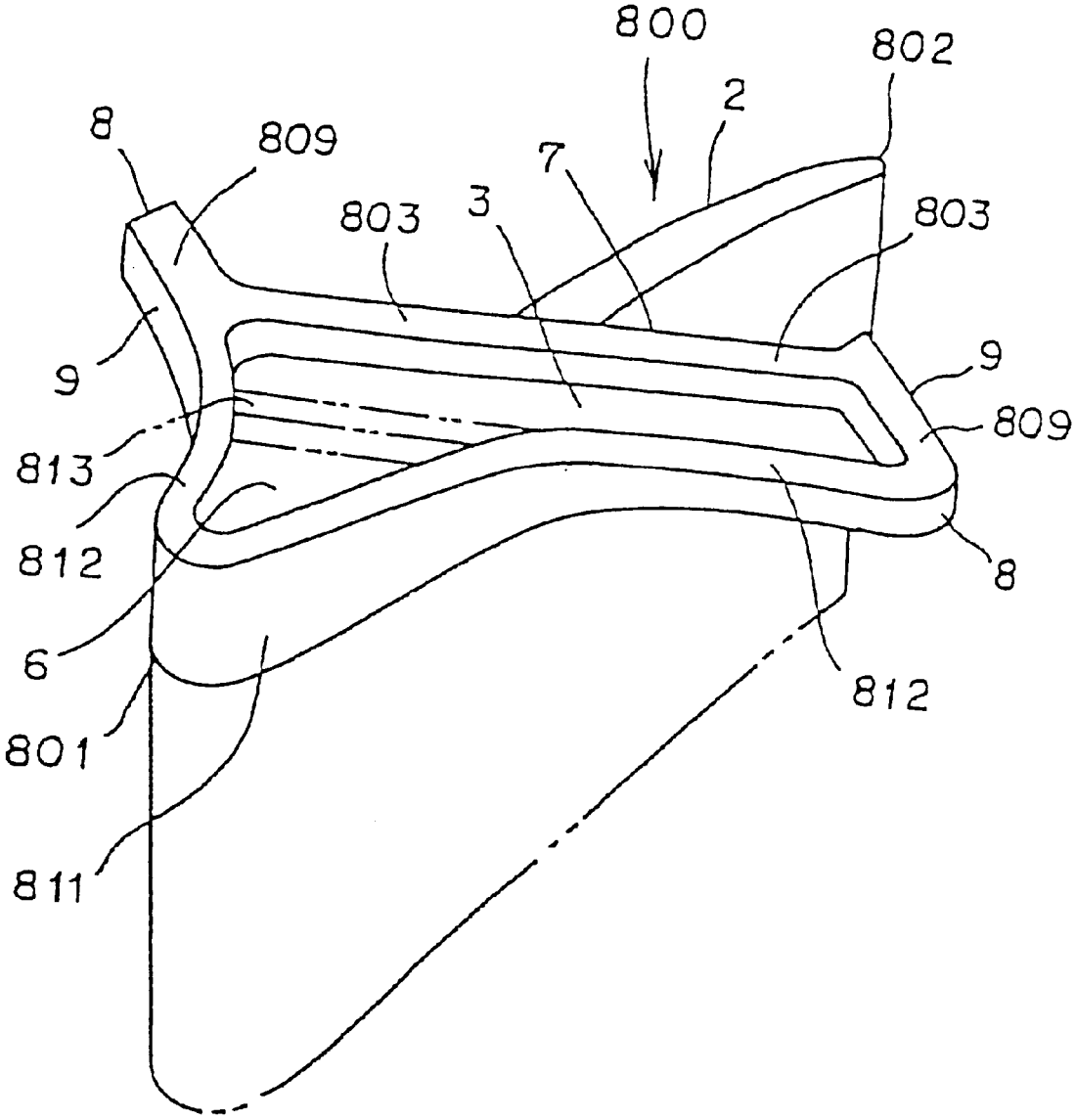
FIG. 15 is a perspective view when viewed from the arrow C shown in FIG. 14.

As indicated by a two-dot chain line in FIG. 15, one or a plurality of reinforcement ribs 813 may be provided on the outer side surface 6 of the shroud 3. Alternatively, as shown in FIG. 13B, the shroud 3 may not be provided with the rib 811 in a shroud integral type moving blade 800'.

Figure 16:
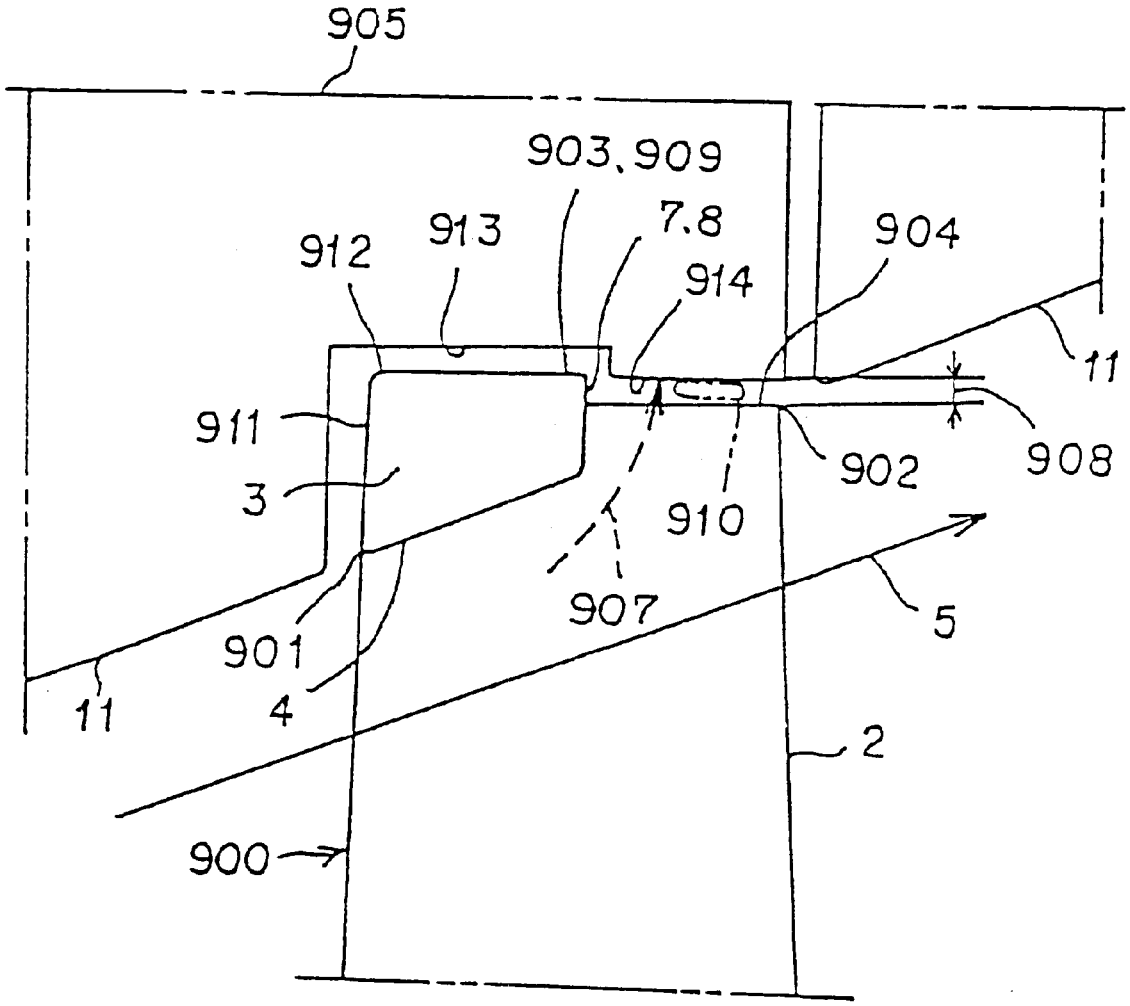
FIG. 16 is an explanatory view which shows a ninth embodiment of the shroud integral type moving blade and the split ring according to the present invention.

A ninth embodiment of this invention will be explained below. FIG. 16 shows the ninth embodiment of the shroud integral type moving blade and the split ring according to the present invention. In FIG. 16, the same reference symbols as those in FIGS. 1 to 15, FIG. 17 and FIG. 18 denote the same elements, respectively. These elements will not be, therefore, explained herein.

A shroud integral type moving blade 900 in the ninth embodiment is a modification of the shroud integral type moving blade 800 in the eighth embodiment. Namely, the shroud integral type moving blade 900 in this embodiment has the following structure. The shroud 3 is provided from a leading edge 901 of the tip of the moving blade 2 to the midpoint of the tip of the moving blade. The seal fin 7 is provided in the midpoint of the tip of the moving blade 2. A flat section 904 is provided from the midpoint of the tip of the moving blade 2 to the trailing edge 902 thereof. The radius of a seal fin tip end 903 is larger than that of the tip flat section 904.

The moving blade 900 in the ninth embodiment has the following structure. A rib 911 as well as the seal fin 7 and the contact 8 is provided on the peripheral edge of the shroud 3. The radius of a rib tip end 912, that of the seal fin tip end 903 and that of a contact tip end 909 are substantially equal to one another. The surface of the rib tip end 912, that of the seal fin tip end 903 and that of the contact tip end 909 are flush with one another.

A split ring 905 in the ninth embodiment is a modification of the split ring 805 in the eighth embodiment. Namely, the split ring 905 of the ninth embodiment has the following structure. A step section 914 is provided from a section 913 which faces the seal fin 7 to a portion downstream of the section 913. The radius of the inner peripheral surface of the step section 914 is slightly smaller than that of the inner peripheral surface of the section 913 which faces the seal fin and slightly larger than that of the tip flat section 904. A leakage flow 907 of the gas path 5 is thereby prevented.

In the ninth embodiment, similarly to the eighth embodiment, a clearance 908 is provided between a surface of the seal fin tip end 903, the tip flat section 904, the contact tip end 909 and the rib tip end 912 of the moving blade 900 and a surface of the inner peripheral surface section 913 facing the seal fin of the split ring 905 and the step section 914. The clearance 908 can be set small to such an extent that these two surfaces do not contact with each other even if they are thermally elongated.

Consequently, in the ninth embodiment, similarly to the eighth embodiment, it is possible to decrease a cavity cross-sectional area 910 which is present between the seal fin 7 and the tip flat section 904 downstream of the seal fin 7 and the inner peripheral surface of the step section 914 of the split ring 905 because of this structure. Therefore, similarly to the preceding first to eighth embodiments, in this embodiment, the leakage flow 907 of the gas path 5 can be prevented. That is, since the leakage flow 907 of the gas path 5 from the clearance 908 causes the deterioration of turbine efficiency, by minimizing the clearance 908, it is possible to suppress the deterioration of the turbine efficiency as much as possible.

In the ninth embodiment, in particular, the shroud 3 does not have a portion which spreads from the tip midpoint of the moving blade 2 to the tip trailing edge 902. It is possible to make the shroud 3 light in weight while keeping the strength of the shroud 3, accordingly.

Furthermore, in the ninth embodiment, the rib 911 as well as the seal fin 7 and the contact 8 is provided on the peripheral edge of the shroud 3. It is, therefore, possible to improve the strength of the shroud 3 while keeping the shroud 3 light in weight.

A reinforcement rib (not shown) may be provided on the outer side surface of the shroud 3. Alternatively, the shroud 3 may not be provided with the rib 911.

Other modification of this invention will be explained below. In the first to ninth embodiments, each of the inner peripheral surfaces of the split rings 105 to 905 has a honeycomb structure (not shown). This honeycomb structure is for facilitating adjustment of the clearances between the inner peripheral surfaces of the split rings 105 to 905 and the shroud integral type moving blades 100 to 900, respectively. This honeycomb structure is also for facilitating adjustment of the clearance between the inner peripheral surface of a split ring and a shroud integral type moving blade of an existing gas turbine. Further, the components of the honeycomb structure can be easily replaced.

As is obvious from the above, the shroud integral type moving blade and the split ring according to one aspect of the present invention can decrease a cavity cross-sectional area which is present between the outer side surface of the shroud and the inner peripheral surface of the split ring on the downstream side of the seal fin. Therefore, the leakage flow which slips out of the gas path through a void near a throat is shut off by the inner peripheral surface of the split ring. Thus, even if a winglet type shroud is employed, it is possible to prevent the leakage flow of the gas path.

The shroud integral type moving blade and the split ring according to another aspect of the present invention can decrease a cavity cross-sectional area which is present between the outer side surface of the shroud and the inner peripheral surface of the split ring on the downstream side of the seal fin. Therefore, the invention according to this aspect can prevent the leakage flow of the gas path.

In the shroud integral type moving blade and the split ring according to the above aspect, in particular, the flat section of the shroud trailing edge makes the shroud light in weight and makes a small cavity cross-sectional area kept as it is even if thermal elongation occurs in an axial direction.

The shroud integral type moving blade and the split ring according to still another aspect of the present invention can decrease a cavity cross-sectional area which is present between the outer side surface of the shroud and the inner peripheral surface of the split ring on a downstream side of the seal fin. In addition, it is possible to narrow the distance between the flat section of the tip trailing edge and the inner peripheral surface of the split ring. Therefore, the invention according to this aspect can prevent the leakage flow of the gas path.

In the shroud integral type moving blade and the split ring according to the above aspect, in particular, similarly to the above aspect, the flat section of the tip trailing edge makes the shroud light in weight and makes a small cavity cross-sectional area kept as it is even if thermal elongation occurs in an axial direction.

In the shroud integral type moving blade and the split ring according to the above aspect, the shroud does not have a portion which corresponds to the tip trailing edge of the moving blade. Accordingly, it is possible to make the shroud light in weight while keeping the strength of the shroud.

Moreover, the shroud integral type moving blade has a structure in which contacts are provided on both ends of the seal fin, respectively, in which the contacts adjacent to each other frictionally abut on each other, in which the radius of the seal fin tip end is substantially equal to the radius of the contact tip end of each of the contacts and in which the surface of the seal fin tip end is flush with the surface of the contact tip end. Therefore, it is possible to improve the strength of the shroud while keeping the shroud light in weight.

The shroud integral type moving blade and the split ring according to still another aspect of the present invention can decrease a cavity cross-sectional area which is present between the outer side surface of the shroud and the inner peripheral surface of the split ring on the downstream side of the seal fin. Therefore, the invention according to this aspect can prevent the leakage flow of the gas path.

The shroud integral type moving blade and the split ring according to still another aspect of the present invention can decrease a cavity cross-sectional area which is present between the seal fin and the tip flat section downstream of the seal fin, and the inner peripheral surface of the split ring. Therefore, the invention according to this aspect can prevent the leakage flow of the gas path.

According to the shroud integral type moving blade based on the above aspect, in particular, the shroud does not have a portion which corresponds to a portion from the tip midpoint of the moving blade to the tip trailing edge thereof. Accordingly, it is possible to make the shroud light in weight while keeping the strength of the shroud.

The shroud integral type moving blade and the split ring according to still another aspect of the present invention can decrease a cavity cross-sectional area which is present between the seal fin and the tip flat section downstream of the seal fin, and the inner peripheral surface of the split ring. In addition, the shroud does not have a portion which corresponds to a portion from the tip midpoint of the moving blade to the tip trailing edge thereof. Accordingly, it is possible to make the shroud light in weight while keeping the strength of the shroud.

Furthermore, the shroud integral type moving blade has a structure in which the rib as well as the seal fin is provided on a peripheral edge of the shroud, in which a radius of a rib tip end is substantially equal to the radius of the seal fin tip end, and in which a surface of the rib tip end is flush with a surface of the seal fin tip end. Therefore, it is possible to improve the strength of the shroud while keeping the shroud light in weight.

Moreover, the split ring has an inner peripheral surface of a honeycomb structure. Therefore, with the honeycomb structure, it is possible to facilitate adjustment of the clearance between the inner peripheral surface of the split ring and the shroud integral type moving blade. In addition, with this honeycomb structure, it is possible to facilitate adjustment of the clearance between the inner peripheral surface of a split ring and a shroud integral type moving blade of an existing gas turbine. Further, the components of the honeycomb structure can be easily replaced.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A shroud integral type moving blade of a gas turbine, the gas turbine comprising the shroud integral type moving blade and a split ring, the shroud integral type moving blade comprising:

a shroud whose inner side surface is inclined along a gas path, and outer side surface is provided with a seal fin which faces an inner peripheral surface of the split ring and seals the outer side surface of the shroud from the inner peripheral surface of the split ring, wherein the shroud integral type moving blade has a structure in which the shroud is provided from a leading edge of a tip of the moving blade to a trailing edge of the tip of the moving blade and a radius of a seal fin tip end is substantially equal to a radius of a trailing edge of the shroud, the split ring has a structure in which a radius of the inner peripheral surface is slightly larger than a radius of the seal fin tip end and the radius of the trailing edge of the shroud, and a radius of the inner peripheral surface of the split ring facing the shroud at the leading edge of the tip of the moving blade is substantially the same as a radius of the inner peripheral surface facing the end of the seal fin tip.

2. The shroud integral type moving blade and the split ring of the gas turbine according to claim 1, wherein the shroud integral type moving blade has a structure in which contacts are provided on both ends of the seal fin, respectively, in which the contacts adjacent to each other frictionally abut on each other, in which the radius of the seal fin tip end is substantially equal to a radius of a contact tip end of each of the contacts, and in which a surface of the seal fin tip end is flush with a surface of the contact tip end.

3. The shroud integral type moving blade and the split ring of the gas turbine according to claim 1, wherein an inner peripheral surface of the split ring has a honeycomb structure.

4. A gas turbine comprising:

a turbine portion having a shroud integral type moving blade according to claim 1;

a casing;

a rotor; and a stationary blade.

5. A shroud integral type moving blade of a gas turbine, the gas turbine comprising the shroud integral type moving blade and a split ring, the shroud integral type moving blade comprising:

a shroud whose inner side surface is inclined along a gas path, and outer side surface is provided with a seal fin which faces an inner peripheral surface of the split ring and seals the outer side surface of the shroud from the inner peripheral surface of the split ring, and wherein the shroud integral type moving blade has a structure in which the shroud is provided from a leading edge of a tip of the moving blade to a trailing edge of the tip of the moving blade, a flat section is provided on a trailing edge of the shroud, and a radius of a seal fin tip end is substantially equal to a radius of a trailing edge of the shroud, the split ring has a structure in which a radius of the inner peripheral surface is slightly larger than a radius of the seal fin tip end and a radius of a flat section of a shroud trailing edge, and a radius of the inner peripheral surface of the split ring facing the shroud at the leading edge of the tip of the moving blade is substantially the same as a radius of the inner peripheral surface facing the end of the seal fin tip.

6. The shroud integral type moving blade and the split ring of the gas turbine according to claim 5, wherein the shroud integral type moving blade has a structure in which contacts are provided on both ends of the seal fin, respectively, in which the contacts adjacent to each other frictionally abut on each other, in which the radius of the seal fin tip end is substantially equal to a radius of a contact tip end of each of the contacts, and in which a surface of the seal fin tip end is flush with a surface of the contact tip end.

7. The shroud integral type moving blade and the split ring of the gas turbine according to claim 5, wherein an inner peripheral surface of the split ring has a honeycomb structure.

8. A gas turbine comprising:

a turbine portion having a shroud integral type moving blade according to claim 5;

a casing;

a rotor; and a stationary blade.

9. A shroud integral type moving blade of a gas turbine, the gas turbine comprising the shroud integral type moving blade and a split ring, the shroud integral type moving blade comprising:

a shroud whose inner side surface is inclined along a gas path, and outer side surface is provided with a seal fin which faces an inner peripheral surface of the split ring and seals the outer side surface of the shroud from the inner peripheral surface of the split ring, wherein the shroud integral type moving blade has a structure in which the shroud is provided from a leading edge of a tip of the moving blade to halfway along a trailing edge of the tip of the moving blade, a flat section is provided on a trailing edge of the tip of the moving blade, and a radius of a seal fin tip end is substantially equal to a radius of the flat section on the trailing edge, and the split ring has a structure in which a radius of the inner peripheral surface is slightly larger than the radius of the seal fin tip end and the radius of the flat section on the trailing edge of the tip.

10. The shroud integral type moving blade and the split ring of the gas turbine according to claim 9, wherein the shroud integral type moving blade has a structure in which contacts are provided on both ends of the seal fin, respectively, in which the contacts adjacent to each other frictionally abut on each other, in which the radius of the seal fin tip end is substantially equal to a radius of a contact tip end of each of the contacts, and in which a surface of the seal fin tip end is flush with a surface of the contact tip end.

11. The shroud integral type moving blade and the split ring of the gas turbine according to claim 9, wherein an inner peripheral surface of the split ring has a honeycomb structure.

12. A shroud integral type moving blade of a gas turbine, the gas turbine comprising the shroud integral type moving blade and a split ring, the shroud integral type moving blade comprising:

a shroud whose inner side surface is inclined along a gas path, and outer side surface is provided with a seal fin which faces an inner peripheral surface of the split ring and seals the outer side surface of the shroud from the inner peripheral surface of the split ring, wherein the shroud integral type moving blade has a structure in which the shroud is provided from a leading edge of a tip of the moving blade to a midpoint of the tip of the moving blade, the seal fin is provided at the midpoint of the tip of the moving blade, a flat section is provided from the midpoint of the tip of the moving blade to a trailing edge of the tip of the moving blade, and a radius of a seal fin tip end is substantially equal to a radius of the flat section, and the split ring has a structure in which a radius of the inner peripheral surface is slightly larger than the radius of the seal fin tip end and the radius of the flat section.

13. The shroud integral type moving blade and the split ring of the gas turbine according to claim 12, wherein the shroud integral type moving blade has the structure in which a rib as well as the seal fin is provided on a peripheral edge of the shroud, in which a radius of a rib tip end is substantially equal to the radius of the seal fin tip end, and in which a surface of the rib tip end is flush with a surface of the seal fin tip end.

14. The shroud integral type moving blade and the split ring of the gas turbine according to claim 12, wherein an inner peripheral surface of the split ring has a honeycomb structure.

15. A shroud integral type moving blade of a gas turbine, the gas turbine comprising the shroud integral type moving blade and a split ring, the shroud integral type moving blade comprising:

a shroud whose inner side surface is inclined along a gas path, and outer side surface is provided with a seal fin which faces an inner peripheral surface of the split ring and seals the outer side surface of the shroud from the inner peripheral surface of the split ring, wherein the shroud integral type moving blade has a structure in which the shroud is provided from a leading edge of a tip of the moving blade to a midpoint of the tip of the moving blade, the seal fin is provided at the midpoint of the tip of the moving blade, a flat section is provided from the midpoint of the tip of the moving blade to a trailing edge of the tip of the moving blade, and a radius of a seal fin tip end is larger than a radius of the flat section of the tip, and the split ring has a structure in which a step section is provided from a portion which faces the shroud to a downward portion, and a radius of an inner peripheral surface of the step section is slightly smaller than a radius of an inner peripheral surface of a portion which faces the shroud.

16. The shroud integral type moving blade and the split ring of the gas turbine according to claim 15, wherein the shroud integral type moving blade has the structure in which a rib as well as the seal fin is provided on a peripheral edge of the shroud, in which a radius of a rib tip end is substantially equal to the radius of the seal fin tip end, and in which a surface of the rib tip end is flush with a surface of the seal fin tip end.

17. The shroud integral type moving blade and the split ring of the gas turbine according to claim 15, wherein an inner peripheral surface of the split ring has a honeycomb structure.

18. A shroud integral type moving blade and a spilt ring of a gas turbine comprising:

the shroud integral type moving blade comprising, a shroud whose inner side surface is inclined along a gas path and outer side surface is provided with a seal fin which faces an inner peripheral surface of the split ring and seals the outer side surface of the shroud from the inner peripheral surface of the split ring, a moving blade having a structure in which the shroud is provided from a leading edge of a tip of the moving blade to a trailing edge of the tip of the moving blade, wherein a radius of a seal fin tip end is substantially equal to a radius of a trailing edge of the shroud; and the split ring, wherein a radius of the inner peripheral surface of the split ring is slightly larger than a radius of the seal fin tip end and the radius of the trailing edge of the shroud, and a radius of the inner peripheral surface of the split ring facing the shroud at the leading edge of the tip of the moving blade is substantially the same as a radius of the inner peripheral surface facing the seal fin tip end.

19. A gas turbine comprising:

a turbine portion having a shroud integral type moving blade and a split ring according to claim 18;

a casing;

a rotor; and a stationary blade.

* * * * *